US008051996B1

(12) United States Patent
Amaya et al.

(10) Patent No.: US 8,051,996 B1
(45) Date of Patent: Nov. 8, 2011

(54) BABY BOTTLE WITH A SPARE NIPPLE STORAGE ASSEMBLY

(76) Inventors: Glenda Amaya, Miami, FL (US); Diana Perez, Miami, FL (US); Angelica Amaya, Miami, FL (US)

( * ) Notice: Subject to any disclaimer, the term of this patent is extended or adjusted under 35 U.S.C. 154(b) by 160 days.

(21) Appl. No.: 11/387,130

(22) Filed: Mar. 23, 2006

(51) Int. Cl.
*A61J 9/00* (2006.01)
*A61J 11/00* (2006.01)
*A61J 11/04* (2006.01)

(52) U.S. Cl. ..... 215/6; 215/11.1; 215/11.6

(58) Field of Classification Search ..... 215/6, 11.1, 215/11.6; 220/711, 717, 744, 916
See application file for complete search history.

(56) References Cited

U.S. PATENT DOCUMENTS

| | | | | |
|---|---|---|---|---|
| 1,451,822 | A | 4/1923 | Hagerty | |
| 4,600,111 | A * | 7/1986 | Brown | 215/6 |
| 4,895,264 | A * | 1/1990 | Phlaphongphanich | 215/11.1 |
| 5,211,299 | A | 5/1993 | Manfredonia | |
| 5,301,833 | A * | 4/1994 | Aycan | 221/96 |
| 5,938,053 | A | 8/1999 | Verbovszky et al. | |
| D428,496 | S | 7/2000 | Thom et al. | |
| 6,253,935 | B1 | 7/2001 | Fletcher | |
| 6,446,821 | B1 | 9/2002 | Salisbury | |
| 2002/0040883 | A1 * | 4/2002 | Ciesla | 215/387 |

FOREIGN PATENT DOCUMENTS

FR 2684549 A1 * 6/1993

* cited by examiner

*Primary Examiner* — Sue A Weaver

(57) ABSTRACT

A baby bottle storage assembly includes a bottle that has a cylindrical body, a chamber formed therein, and has open top and closed bottom ends. First and second coextensive protective caps are conjoined to the top and bottom ends. The second protective cap has a cavity positioned adjacent to the body's bottom end, defining a storage chamber when the second protective cap is secured to the bottom end. A first discharge nozzle is intercalated between the first protective cap and the body's top end, and has a nipple protruding outwardly from the first protective cap. Spare discharge nozzles are housed within the storage chamber and are intercalated between the second protective cap and the body's bottom end such that the spare discharge nozzles are isolated from ambient surroundings. The first and spare discharge nozzles are formed from resilient rubber material.

8 Claims, 4 Drawing Sheets

BABY BOTTLE WITH A SPARE NIPPLE STORAGE ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to bottles assemblies and, more particularly, to a baby bottle storage assembly for use when feeding an infant.

2. Prior Art

It is well known that older babies and toddlers usually hold their own bottles. Often, the result of this is that the bottle is purposely or inadvertently dropped by the child onto the floor or carpet. As such, the bottle, especially the simulated nipple portion thereof, becomes contaminated with dirt and germs that can be harmful to the youngster, should they resume drinking from the contaminated nipple. The only options left for parents are to clean and sterilize the contaminated nipple, or to find a clean and sterilized nipple and attach it to the bottle.

The process of properly cleaning and sterilizing a nipple is actually rather time consuming and involves washing the nipple for extended periods of time at high temperatures. Most parents substitute this lengthy procedure for a simple rinse of the nipple under cold tap water, which truthfully only removes the dirt but does not eliminate small microbes and viruses that the bottle may have come in contact with. As for finding a replacement nipple, most busy and hurried parents finds this to be too much of a time consuming process, thus explaining why they simply choose to quickly rinse the bottle under some tap water.

Accordingly, a need remains for a baby bottle storage assembly in order to overcome the above-noted shortcomings. The present invention satisfies such a need by providing a baby bottle assembly that is easy and convenient to use, practical in design, and significantly improves a parent's ability to provide their child with sanitary bottle nipples. Such a baby bottle assembly provides a stored sterilized and clean nipple on the bottle itself. A parent or caregiver simply removes the contaminated nipple and replace it with a clean one. This is a much less time consuming task than searching for a clean nipple or attempting to properly sterilize the contaminated one. In addition, the dirty nipple can conveniently be stored in the previous location of the clean nipple so that same is not misplaced prior to the cleaning thereof.

BRIEF SUMMARY OF THE INVENTION

In view of the foregoing background, it is therefore an object of the present invention to provide a baby bottle storage assembly. These and other objects, features, and advantages of the invention are provided by a baby bottle storage assembly for use when feeding an infant.

The baby bottle storage assembly includes a baby bottle that has a uniform and continuous cylindrical body provided with a centrally registered longitudinal axis. Such a body further has a chamber formed therein. The body also has an open top end and a closed bottom end axially opposed therefrom.

Such a bottom end may have a chamfered wall converging upwardly towards the longitudinal axis. The chamfered wall protrudes into the chamber and forms an apex centrally oriented with the longitudinal axis. The bottom end further has a unitary and continuous outer flange monolithically formed therewith. Such an outer flange extends downwardly from the body and travels along an edge of the body wherein the outer flange is spaced inwardly of the edge of the body. The flange has a threaded outer surface extending along an entire perimeter of the outer flange.

First and second coextensively shaped protective caps are threadably conjoined directly to the top end and directly conjoined to the bottom end respectively. Such a second protective cap has a interior cavity contiguously positioned adjacent to the bottom end of the body such that a storage chamber is effectively defined between the bottom end of the body and the second protective cap after the second protective cap is secured directly to the bottom end of the body. The first protective cap may have a centrally oriented aperture formed therein such that the nipple of the first discharge nozzle passes through the aperture.

A first discharge nozzle is intercalated between the first protective cap and the top end of the body. Such a first discharge nozzle has a nipple protruding outwardly from the first protective cap that is positionable into a mouth of the infant in such a manner that the infant can advantageously and effectively extract fluid through the first discharge nozzle while the first protective cap is attached to the body. The first discharge nozzle has a monolithically formed outer rib bulging away therefrom that is directly engaged with a perimeter of the aperture for advantageously and effectively maintaining the first discharge nozzle at a substantially stable position during feeding conditions.

A plurality of spare discharge nozzles are housed within the storage chamber. Such spare discharge nozzles are spaced from the first discharge nozzle. The spare discharge nozzles are intercalated between the second protective cap and the bottom end of the body such that the spare discharge nozzles are conveniently and effectively isolated from ambient surroundings while housed within the storage chamber.

Such spare discharge nozzles are preferably tightly nested within the second protective cap. Each of the spare discharge nozzles has a nipple monolithically formed therewith. Such nipples are housed upwardly and inwardly into the chamfered bottom end of the body and are nested within the storage chamber. The spare discharge nozzles may be vertically stacked with the nipples being vertically positioned along the longitudinal axis during storage conditions. The first discharge nozzle and the spare discharge nozzles are formed from resilient rubber material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
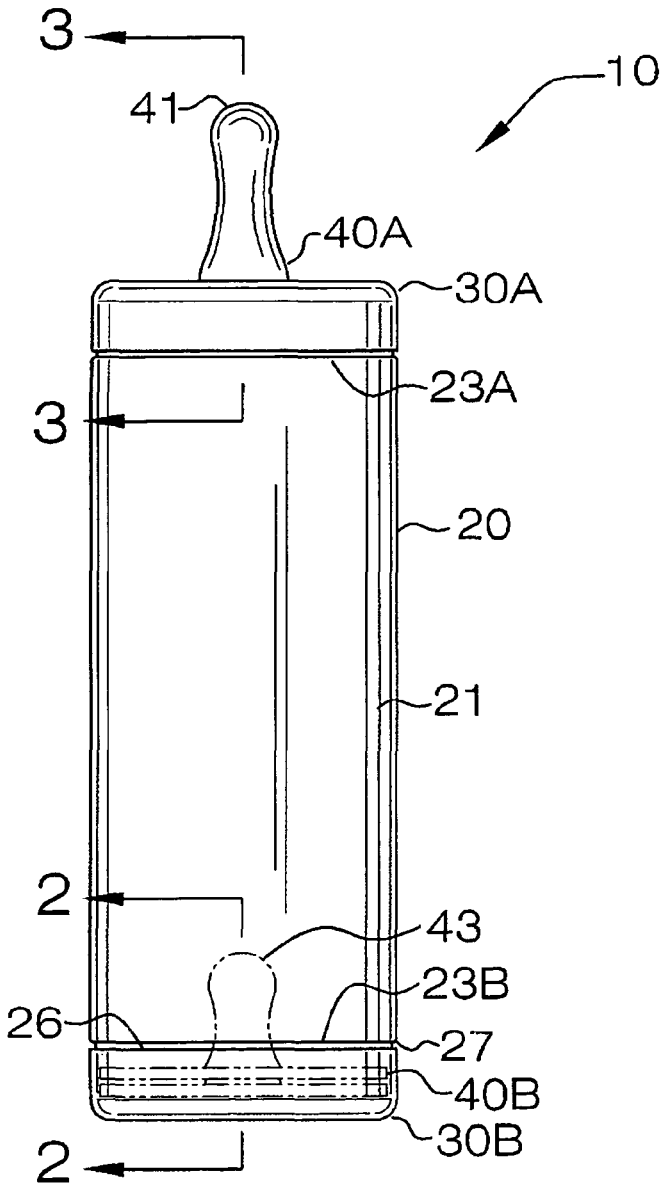
FIG. 1 is a side-elevational view showing a baby bottle storage assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-4 by the reference numeral 10 and is intended to provide a baby bottle storage assembly. It should be understood that the assembly 10 may be used to store many different types of items and should not be limited in use to only storing replacement discharge nozzles.

Referring initially to FIGS. 1 through 4, the assembly 10 includes a baby bottle 20 that has a uniform and continuous cylindrical body 21 provided with a centrally registered longitudinal axis. Of course, the body 21 of the baby bottle 20 may be produced in a variety of different shapes, sizes, and colors, as is obvious to a person of ordinary skill in the art. Such a body 21 further has a chamber 22 formed therein. The body also has an open top end 23A and a closed bottom end 23B axially opposed therefrom.

Figure 2:
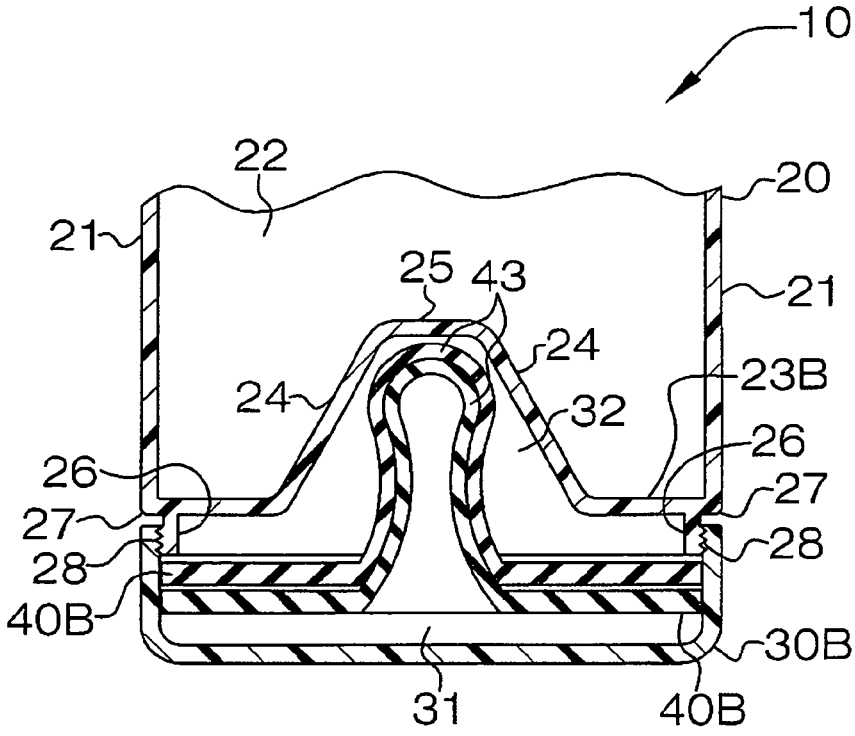
FIG. 2 is an enlarged cross-sectional view of the assembly shown in FIG. 1, taken along line 2-2.
Figure 4:
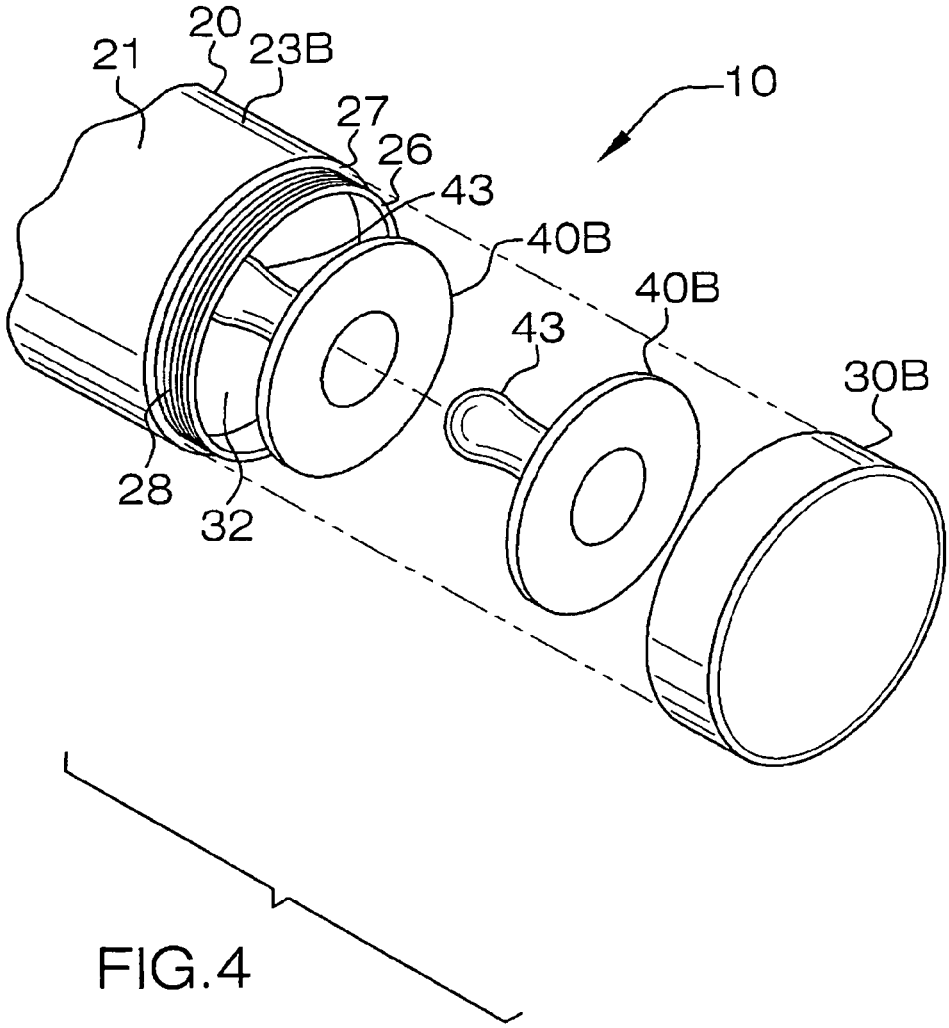
FIG. 4 is an exploded perspective view of the bottom end shown in FIG. 1.

Referring to FIGS. 1, 2 and 4, such a bottom end 23B has a chamfered wall 24 converging upwardly towards the longitudinal axis, which is critical for ensuring the spare discharge nozzles 40B (described hereinbelow) can be effectively stored and isolated from the environment. The chamfered wall 24 protrudes into the chamber 22 and forms an apex 25 centrally oriented with the longitudinal axis. The bottom end 23B further has a unitary and continuous outer flange 26 monolithically formed therewith. Such an outer flange 26 extends downwardly from the body 21 and travels along an edge 27 of the body 21 wherein the outer flange 26 is spaced inwardly of the edge 27 of the body 21. The flange 26 has a threaded outer surface 28 extending along an entire perimeter of the outer flange 26, which is critical for maximizing the storage chamber (described hereinbelow) for housing the spare discharge nozzles 40B.

Referring to FIGS. 1 through 4, first 30A and second 30B coextensively shaped protective caps are threadably conjoined directly, without the use of intervening elements, to the top end 23A and directly conjoined, without the use of intervening elements, to the bottom end 23B respectively. Such a second protective cap 30B has a interior cavity 31 contiguously positioned adjacent to the bottom end 23B of the body 21, which is essential such that a storage chamber 32 is effectively defined between the bottom end 23B of the body 21 and the second protective cap 30B after the second protective cap 30B is secured directly, without the use of intervening elements, to the bottom end 23B of the body 21. The first protective cap 30A has a centrally oriented aperture 33 formed therein such that the nipple 41 (described herein below) of the first discharge nozzle 40A (described herein below) passes through the aperture 33.

Figure 3:
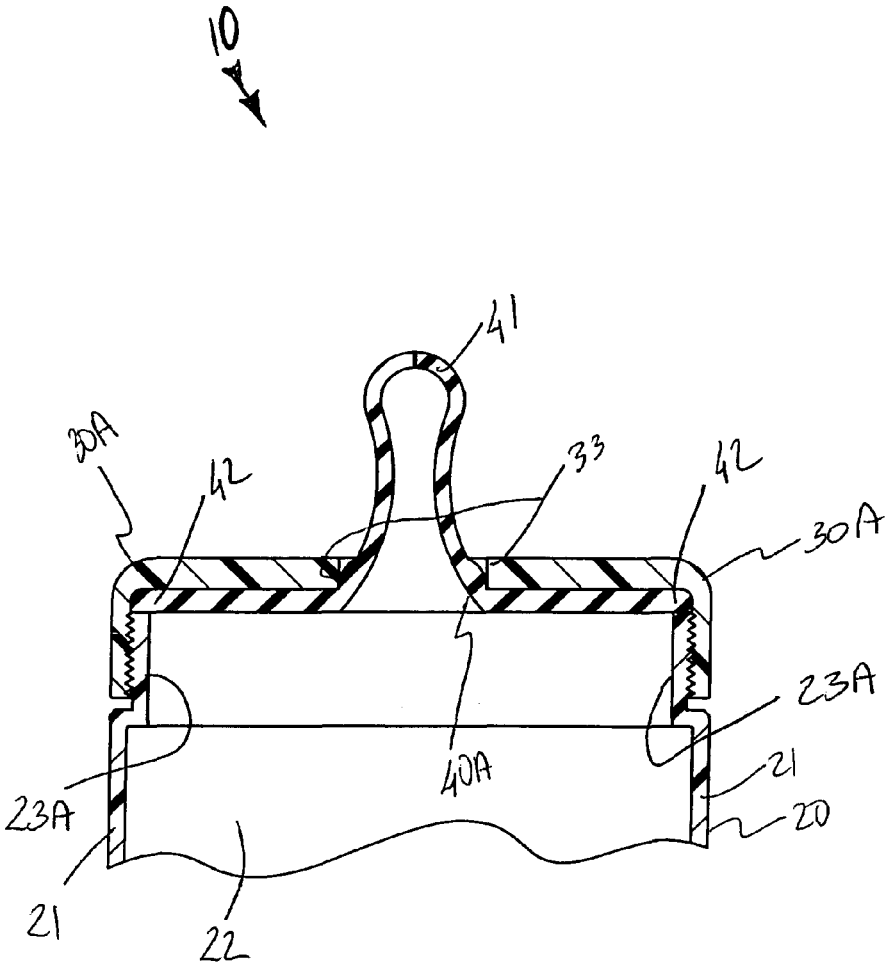
FIG. 3 is an enlarged cross-sectional view of the assembly shown in FIG. 1, taken along line 3-3.

Referring to FIGS. 1 and 3, a first discharge nozzle 40A is intercalated between the first protective cap 30A and the top end 23A of the body 21. Such a first discharge nozzle 40A has a nipple 41 protruding outwardly from the first protective cap 30A that is positionable into a mouth of the infant in such a manner that the infant can advantageously and effectively extract fluid through the first discharge nozzle 40A while the first protective cap 30A is attached to the body 21. The first discharge nozzle 40A has a monolithically formed outer rib 42 bulging away therefrom that is directly engaged, without the use of intervening elements, with a perimeter of the aperture 33, which is crucial for advantageously and effectively maintaining the first discharge nozzle 40A at a substantially stable position during feeding conditions.

Referring to FIGS. 1, 2 and 4, a plurality of spare discharge nozzles 40B are housed within the storage chamber 32. Such spare discharge nozzles 40B are spaced from the first discharge nozzle 40A. The spare discharge nozzles 40B are intercalated between the second protective cap 30B and the bottom end 23B of the body 21, which is a vital feature such that the spare discharge nozzles 40B are conveniently and effectively isolated from ambient surroundings while housed within the storage chamber 32, thus ensuring that the sanitary integrity thereof is maintained.

Still referring to FIGS. 1, 2 and 4, such spare discharge nozzles 40B are tightly nested within the second protective cap 30B. Each of the spare discharge nozzles 40B has a nipple 43 monolithically formed therewith. Such nipples 43 are housed upwardly and inwardly into the chamfered bottom end 23B of the body 21 and are nested within the storage chamber 32. The spare discharge nozzles 40B are vertically stacked with the nipples 43 being vertically positioned along the longitudinal axis during storage conditions. The first discharge nozzle 40A and the spare discharge nozzles 40B are formed from resilient rubber material. Of course, the discharge nozzles 40 may be produced from any other suitable material, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A baby bottle storage assembly for use when feeding an infant, said baby bottle storage assembly comprising:

a baby bottle having a uniform and continuous cylindrical body provided with a centrally registered longitudinal axis, said body further having a chamber formed therein, said body having an open top end and a closed bottom end axially opposed therefrom;

first and second protective caps threadably conjoined directly to said top end and directly conjoined to said bottom end respectively, said second protective cap having a interior cavity contiguously positioned adjacent to said bottom end of said body such that a storage chamber is defined between said bottom end of said body and said second protective cap after said second protective cap is secured directly to said bottom end of said body;

a first discharge nozzle intercalated between said first protective cap and said top end of said body, said first discharge nozzle having a nipple protruding outwardly from said first protective cap and being positionable into a mouth of the infant in such a manner that said infant can extract fluid through said first discharge nozzle while said first protective cap is attached to said body; and a plurality of spare discharge nozzles housed within said storage chamber, said spare discharge nozzles being spaced from said first discharge nozzle, said spare discharge nozzles being intercalated between said second protective cap and said bottom end of said body such that said spare discharge nozzles are isolated from ambient surroundings while housed within said storage chamber;

wherein said spare discharge nozzles are tightly nested within said second protective cap, each of said spare discharge nozzles having a nipple monolithically formed therewith, said nipples being housed upwardly and inwardly into said bottom end of said body and nested within said storage chamber;

wherein said bottom end having a chamfered wall converging upwardly towards the longitudinal axis, said chamfered wall protruding into said chamber and forming an apex centrally oriented with the longitudinal axis, said bottom end further having a unitary and continuous outer flange monolithically formed therewith, said outer flange extending downwardly from said body and traveling along an edge of said body wherein said outer flange is spaced inwardly of said edge of said body, said flange having a threaded outer surface extending along an entire perimeter of said outer flange.

2. The assembly of claim 1, wherein said spare discharge nozzles are vertically stacked with said nipples being vertically positioned along the longitudinal axis during storage conditions.

3. The assembly of claim 1, wherein said first protective cap has a centrally oriented aperture formed therein such that said nipple of said first discharge nozzle passes through said aperture.

4. The assembly of claim 3, wherein said first discharge nozzle has a monolithically formed outer rib bulging away therefrom and directly engaged with a perimeter of said aperture for maintaining said first discharge nozzle at a substantially stable position during feeding conditions.

5. A baby bottle storage assembly for use when feeding an infant, said baby bottle storage assembly comprising:

a baby bottle having a uniform and continuous cylindrical body provided with a centrally registered longitudinal axis, said body further having a chamber formed therein, said body having an open top end and a closed bottom end axially opposed therefrom;

first and second coextensively shaped protective caps threadably conjoined directly to said top end and directly conjoined to said bottom end respectively, said second protective cap having a interior cavity contiguously positioned adjacent to said bottom end of said body such that a storage chamber is defined between said bottom end of said body and said second protective cap after said second protective cap is secured directly to said bottom end of said body;

a first discharge nozzle intercalated between said first protective cap and said top end of said body, said first discharge nozzle having a nipple protruding outwardly from said first protective cap and being positionable into a mouth of the infant in such a manner that said infant can extract fluid through said first discharge nozzle while said first protective cap is attached to said body; and a plurality of spare discharge nozzles housed within said storage chamber, said spare discharge nozzles being spaced from said first discharge nozzle, said spare discharge nozzles being intercalated between said second protective cap and said bottom end of said body such that said spare discharge nozzles are isolated from ambient surroundings while housed within said storage chamber;

wherein said spare discharge nozzles are tightly nested within said second protective cap, each of said spare discharge nozzles having a nipple monolithically formed therewith, said nipples being housed upwardly and inwardly into said bottom end of said body and nested within said storage chamber;

wherein said bottom end having a chamfered wall converging upwardly towards the longitudinal axis, said chamfered wall protruding into said chamber and forming an apex centrally oriented with the longitudinal axis, said bottom end further having a unitary and continuous outer flange monolithically formed therewith, said outer flange extending downwardly from said body and traveling along an edge of said body wherein said outer flange is spaced inwardly of said edge of said body, said flange having a threaded outer surface extending along an entire perimeter of said outer flange.

6. The assembly of claim 5, wherein said spare discharge nozzles are vertically stacked with said nipples being vertically positioned along the longitudinal axis during storage conditions.

7. The assembly of claim 5, wherein said first protective cap has a centrally oriented aperture formed therein such that said nipple of said first discharge nozzle passes through said aperture.

8. The assembly of claim 7, wherein said first discharge nozzle has a monolithically formed outer rib bulging away therefrom and directly engaged with a perimeter of said aperture for maintaining said first discharge nozzle at a substantially stable position during feeding conditions.

* * * * *